US005868876A

United States Patent [19]

Bianco et al.

[11] Patent Number: 5,868,876

[45] Date of Patent: Feb. 9, 1999

[54] HIGH-STRENGTH, CREEP-RESISTANT MOLYBDENUM ALLOY AND PROCESS FOR PRODUCING THE SAME

[75] Inventors: Robert Bianco, Finleyville; R. William Buckman, Jr.; Clint B. Geller, both of Pittsburgh, all of Pa.

[73] Assignee: The United States of America as represented by the United States Department of Energy, Washington, D.C.

[21] Appl. No.: 856,503

[22] Filed: May 15, 1997

Related U.S. Application Data

[60] Provisional application No. 60/017,795 May 17, 1996.

[51] Int. Cl.[6] ..... C22C 14/00

[52] U.S. Cl. ..... 148/407; 419/20; 75/232; 75/235

[58] Field of Search ..... 148/423, 407; 420/429; 419/20; 75/232, 235

[56] References Cited

U.S. PATENT DOCUMENTS

| | | | |
|---|---|---|---|
| 4,115,113 | 9/1978 | Fustier et al. | 419/30 |
| 4,622,068 | 11/1986 | Rowe et al. | 75/245 |
| 4,950,327 | 8/1990 | Eck et al. | 75/232 |
| 5,049,355 | 9/1991 | Gennari et al. | 420/425 |
| 5,051,139 | 9/1991 | Eck | 148/11.5 F |
| 5,102,474 | 4/1992 | Eck et al. | 148/11.5 P |
| 5,590,392 | 12/1996 | Ishiwata et al. | 75/232 |
| 5,606,141 | 2/1997 | Leichtfried | 75/235 |

FOREIGN PATENT DOCUMENTS 0 119 438 9/1984 European Pat. Off. .

OTHER PUBLICATIONS

R. Bianco and R.W. Buckman, Jr., "Evaluation of Oxide Dispersion Strengthened (ODS) Molybdenum Alloys", Symposium of High Temperature Materials, Am. Soc. of Materials, General Electric R&D Center, Schenectady, N.Y., May 19, 1995.

*Primary Examiner*—John Sheehan

*Attorney, Agent, or Firm*—Virginia B. Caress; William R. Moser; Paul A. Gottlieb

[57] ABSTRACT

A wet-doping process for producing an oxide-dispersion strengthened (ODS), creep-resistant molybdenum alloy is disclosed. The alloy is made by adding nitrate or acetate salts of lanthanum, cerium, thorium, or yttrium to molybdenum oxide to produce a slurry, heating the slurry in a hydrogen atmosphere to produce a powder, mixing and cold isostatically pressing the powder, sintering in a hydrogen atmosphere, and thermomechanically processing (swaging, extruding, cold drawing) the product. The ODS molybdenum alloy produced by the process contains 2–4% by volume (~1–4% by weight) of an oxide of lanthanum, cerium, thorium, or yttrium. The alloy has high strength and improved creep-resistance at temperatures greater than $0.55T_m$ of molybdenum.

32 Claims, 10 Drawing Sheets

CHEMICAL ANALYSIS RESULTS OF THE THERMOMECHANICALLY PROCESSED ODS MOLYBDENUM ALLOYS

| ALLOY COMPOSITION | NOMINAL COMPOSITION (WT. %)# | | | | CALCULATED OXIDE VOLUME PERCENT | |
|---|---|---|---|---|---|---|
| | Y | Ce | La | O | | |
| 2 vol.% CERIA | - | 1.17 | - | 0.22 | ($Ce_2O_3$) 2.02 | ($CeO_2$) 2.04 |
| 4 vol. % CERIA | - | 2.24 | - | 0.43 | 3.85 | 3.89 |
| 2 vol. % LANTHANA | - | - | 1.07 | 0.20 | 1.95 | |
| 4 vol. % LANTHANA | - | - | 1.72 | 0.32 | 3.13 | |
| 2 vol. % YTTRIA | 0.72 | - | - | 0.22 | 1.84 | |
| 4 vol. % YTTRIA | 1.47 | - | - | 0.43 | 3.73 | |

ALL MAJOR IMPURITY LEVELS LESS THAN 50 ppmw

FIG. 1

OXIDE PARTICLE AND PRIMARY GRAIN SIZE OF AS-SINTERED AND THERMOMECHANICALLY PROCESSED ODS MOLYBDENUM ALLOY BILLETS

| ALLOY COMPOSITION | As-SINTERED ALLOYS | | As-SWAGED ALLOYS | |
|---|---|---|---|---|
| | AVERAGE GRAIN DIA, μm | OXIDE PARTICLE SIZE, μm | AVERAGE GRAIN WIDTH , μm | OXIDE PARTICLE SIZE, μm |
| 2 vol. % CERIA | 96 | 1.13± 0.56 | 0.75± 0.18# | 0.15 ± 0.10 ▾# |
| 4 vol. % CERIA | 10 | 1.98 ± 0.63 | 0.60 ± 0.29# | 0.23 ± 0.15▾# |
| 2 vol. % LANTHANA | 49 | 1.73 ± 0.65 | 0.50 ± 0.30# | 0.23 ± 0.11▾# |
| 4 vol. % LANTHANA | 11.6 | 2.29 ± 0.89 | 0.80 ± 0.14# | 0.45 ± 0.28▾# |
| 2 vol. % YTTRIA | 9.4 | 2.64± 1.29 | 0.51± 0.13# | 0.16 ± 0.08# |
| 4 vol. % YTTRIA | 8.5 | 2.91± 1.76 | 0.65 ± 0.27# | 0.41± 0.18# |
| 2 vol. % THORIA | 2.4 (AE) | 1.05± 0.26 (AE) | 0.35 ± 0.12# | 0.13 ± 0.08# |

Analytical/transmission electron microcopy results.

▾ Average width of plastically deformed oxide stringers.

AE = As-Extruded

FIG. 2

ONE HOUR RECRYSTALLIZATION TEMPERATURE OF THERMOMECHANICALLY PROCESSED ODS MOLYBDENUM ALLOYS, COMMERCIAL MOLYBDENUM ALLOYS, AND OTHER ODS SYSTEMS

| ALLOY ID | ALLOY COMPOSITION | RECRYSTALLIZATION TEMPERATURE , °F | NORMALIZED TEMPERATURE, $RXT/T_m$ |
|---|---|---|---|
| 2CW | 2 vol. % CERIA | 2910 | 0.65 |
| 4CW | 4 vol. % CERIA | 3630 | 0.79 |
| 2LW | 2 vol. % LANTHANA | 2910 | 0.85 |
| 4LW | 4 vol. % LANTHANA | 3270 | 0.72 |
| 2YW | 2 vol. % YTTRIA | 2730 | 0.58 |
| 4YW | 4 vol. % YTTRIA | 2550 | 0.53 |
| 2TW | 2 vol. % THORIA | 3990 | 0.84 |
| **COMMERCIAL MOLYBDENUM ALLOYS AND OTHER ODS SYSTEMS** | | | |
| UNALLOYED Mo | Mo-0.01C w/o | 2150 | 0.45 |
| Mo TZC | Mo-1.25Ti-0.15Zr-0.15C w/o | 2800 | 0.59 |
| MoReHfC | Mo-2.0Re-0.5HfC w/o | 3050 | 0.67 |
| ThDW | W-3.8 vol. % $ThO_2$ | 5252 | 0.86 |
| TDNi | Ni-2.0 vol. % $ThO_2$ | 2462 | 0.94 |

NOTE: RECRYSTALLIZATION TEMPERATURE DETERMINED FROM BOTH HARDNESS DROP AND POST-ANNEAL METALLOGRAPHY.

FIG. 3

ROOM TEMPERATURE (78°F) TENSILE TEST DATA OF THERMOMECHANICALLY PROCESSED ODS MOLYBDENUM ALLOY RODS LOADED TO FAILURE AT A STRAIN RATE OF 0.05 $MIN^{-1}$ OR $8.33 \times 10^{-4}$ $SEC^{-1}$

| SAMPLE COMPOSITION | 0.2 % YIELD STRESS (psi) | ULTIMATE TENSILE STRENGTH (psi) | ELONGATION TO FAILURE (%) | REDUCTION IN CROSS-SECTIONAL AREA (%) AFTER TEST |
|---|---|---|---|---|
| UNALLOYED MOLYBDENUM | 78,500 | 89,700 | 21.3 | 71.9 |
| 2 vol. % CERIA | 107,031 | 118,750 | 13.1 | 57.8 |
| 4 vol. % CERIA | 140,476 | 159,206 | 7.1 | 54.0 |
| 2 vol. % LANTHANA | 107,936 | 119,841 | 13.0 | 58.7 |
| 4 vol. % LANTHANA | 132,031 | 148,438 | 7.6 | 29.7 |
| 2 vol. % YTTRIA | 128,571 | 138,889 | 13.6 | 49.2 |
| 4 vol. % YTTRIA | 128,095 | 142,857 | 5.9 | 41.3 |
| 2 vol. % THORIA | 118,000 | 144,500 | 24.2 | 57.5 |

FIG. 4

ROOM TEMPERTURE (78°F) TENSILE DATA OF ODS MOLYBDENUM ALLOY RODS VACUUM ANNEALED AT 3630°F FOR ONE HOUR LOADED TO FAILURE AT A STRAIN RATE OF 0.05 $MIN^{-1}$ OR 8.33 $x10^{-4}$ $SEC^{-1}$

| SAMPLE COMPOSITION | 0.2% YIELD STRESS (psi) | ULTIMATE TENSILE STRESS (psi) | ELONGATION TO FAILURE (%) | REDUCTION IN CROSS-SECTIONAL AREA (%) |
|---|---|---|---|---|
| Unalloyed Molybdenum | 42,900 | 69,800 | 9.6 | 14.3 |
| 2 vol% CERIA | 56,465 | 76,850 | 25.4 | 59.8 |
| 4 vol. % CERIA | 73,560 | 105,550 | 39.0 | 56.4 |
| 2 vol.% LANTHANA | 52,820 | 76,550 | 28.9 | 65.2 |
| 4 vol. % LANTHANA | 72,770 | 100,940 | 33.6 | 56.5 |
| 2 vol. YTTRIA | 61,460 | 89,910 | 8.4 | 9.5 |
| 4 vol. YTTRIA | 70,570 | 100,240 | 22.3 | 25.7 |
| 2 vol. THORIA | 95,300 | 123,300 | 34.1 | 52.6 |

FIG. 5

DUCTILE -TO-BRITTLE TRANSITION TEMPERATURES (DBTT) OF ODS MOLYBDENUM ALLOY RODS LOADED TO FAILURE AT A STRAIN RATE OF 0.05 $MIN^{-1}$ OR $8.33x10^{-4}$ $SEC^{-1}$

| SAMPLE COMPOSITION | DUCTILE-TO-BRITTLE TRANSITION TEMPERATURE, °F | |
|---|---|---|
| | AS-SWAGED | ONE HOUR VACCUM ANNEAL AT 3630°F |
| UNALLAYED MOLYBDENUM | -13 | > 150 |
| 2 vol.% CERIA | -103 | 122 |
| 4 vol.% CERIA | -148 | -58 |
| 2 vol. % LANTHANA | -103 | 122 |
| 4 vol. % LANTHANA | < - 148 | -13 |
| 2 vol. % YTTRIA | < - 148 | 212 |
| 4 vol. % YTTRIA | -148 | 212 |
| 2 vol. %THORIA | < - 103 | 122 |

FIG. 6

ELEVATED TEMPERATURE (2910° F OR 1600°C) TENSILE DATA OF THERMOMECHANICALLY PROCESSED ODS MOLYBDENUM ALLOY RODS LOADED TO FAILURE AT A STRAIN RATE OF 0.5 $MIN^{-1}$ OR $8.3X10^{-4}$ $SEC.^{-1}$

| SAMPLE COMPOSITION | 0.2% OFFSET YIELD STRESS (psi) | ULITIMATE TENSILE STRESS (psi) | ELONGATION TO FAILURE (%) | REDUCTION IN CROSS-SECTIONAL AREA (%)AFTER TEST |
|---|---|---|---|---|
| Unalloyed Molybdenum | 4,000 | 7,200 | 31.6 | 36.5 |
| 2 vol. % CERIA | 9,160 | 10,470 | 25.6 | 31.8 |
| 4 vol. % CERIA | 8,070 | 10,730 | 37.5 | 20.2 |
| 2 vol. % LANTHANA | 11,570 | 13,550 | 23.6 | 29.1 |
| 4 vol. % LANTHANA | 6,470 | 12,480 | 29.0 | 16.6 |
| 2 vol. % YTTRIA | 7,150 | 9,440 | 20.0 | 13.6 |
| 4 vol. % YTTRIA | 5,180 | 7,000 | 26.0 | 15.6 |
| 2 vol.% THORIA | 9,100 | 16,300 | 12.0 | 11.6 |

FIG. 7

ELEVATED TEMPERATURE (3272°F OR 1800°C) TENSILE DATA OF THERMOMECHANICALLY PROCESSED ODS MOLYBDENUM ALLOY RODS LOADED TO FAILURE AT A STRAIN RATE OF 0.05 $MIN^{-1}$ OR $8.33X10^{-4}$ $SEC^{-1}$

| SAMPLE COMPOSITION | 0.2% OFFSET YEILD STRESS (psi) | ULTIMATE TENSILE STRESS (psi) | ELONGATION TO FAILURE (%) | REDUCTION IN CROSS-SECTIONAL AREA (%) AFTER TEST |
|---|---|---|---|---|
| Unalloyed Molybdenum | 2,200 | 5,000 | 30.8 | 27.7 |
| 2 vol.% CERIA | 6,080 | 6,380 | 36 | 56.5 |
| 4 vol. % CERIA | 2,820 | 5,780 | 36 | 24.5 |
| 2 vol. % LANTHANA | 6,390 | 7,080 | 42 | 49.5 |
| 4 vol. % LANTHANA | 3,580 | 6,090 | 34 | 38.8 |
| 2 vol. % YTTRIA | 5,140 | 6,150 | 18 | 6.4 |
| 4 vol. % YTTRIA | 5,330 | 6,480 | 18 | 13.6 |
| 2 vol. % THORIA | 7,600 | 13,400 | 16.7 | 36 |

FIG. 8

CONSTANT-LOAD, UNIAXIAL CREEP PROPERTIES OF ODS MOLYBDENUM ALLOYS OF INVENTION

| SPECIMEN ID | APPLIED STRESS (KSI) | TEST TEMPERATURE (°C) | MINIMUM CREEP RATE ($hr^{-1}$) |
|---|---|---|---|
| 2 vol. % LANTHANA | 1.5 | 1600 | $<10^{-9}$ |
| 2 vol. % LANTHANA | 5.0 | 1600 | $8.6 \times 10^{-6}$ |
| 2 vol. % LANTHANA | 1.5 | 1700 | $2.0 \times 10^{-7}$ |
| 2 vol. % LANTHANA | 3.0 | 1700 | $2.4 \times 10^{-6}$ |
| 2 vol. % LANTHANA | 3.0 | 1800 | $1.8 \times 10^{-6}$ |
| 4 vol. % LANTHANA | 5.0 | 1600 | $3.8 \times 10^{-6}$ |
| 2 vol. % CERIA | 3.0 | 1700 | $1.9 \times 10^{-6}$ |
| 2 vol.% CERIA | 3.0 | 1800 | $4.0 \times 10^{-6}$ |
| 4 vol. % CERIA | 1.5 | 1600 | $8.5 \times 10^{-6}$ |
| 2 vol. % YTTRIA | 3.0 | 1400 | $2.5 \times 10^{-5}$ |
| 2 vol. % YTTRIA | 5.0 | 1400 | $6.7 \times 10^{-3}$ |

FIG. 9

HIGH-STRENGTH, CREEP-RESISTANT MOLYBDENUM ALLOY AND PROCESS FOR PRODUCING THE SAME

RIGHTS OF THE GOVERNMENT

The United States Government has rights in this invention pursuant to a contract awarded by the U.S. Department of Energy.

This application claims the benefit of U.S. Provisional Application Ser. No. 60/017,795 filed on May 17, 1996.

FIELD OF THE INVENTION

The present invention relates to a wet-doping process of producing a high strength, creep-resistant molybdenum alloy containing a very fine dispersion of oxide particles. Oxides of lanthanum, cerium, thorium and yttrium are dispersed in a molybdenum matrix in amounts of about 2–4 volume percent (~1–4 wt. percent).

BACKGROUND AND SUMMARY OF THE INVENTION

Molybdenum (Mo), a refractory metal from Group VI of the Periodic Table, can be strengthened by (a) solid-solution strengthening additions, (b) precipitation or dispersion strengthening by second-phase particles, (c) strain hardening and grain size refinement, and (d) retaining a worked structure at high temperatures. For service at elevated temperatures (>0.5$T_m$, where $T_m$ is the absolute melting temperature) only a combination of (b), (c), and (d) has the potential for success.

Strengthening by second-phase particles can be both direct and indirect as demonstrated for the SAP (sintered aluminum product) and TD (thoria dispersion strengthened) Nickel and TD NICHROME® alloys. Direct strengthening is caused by particles acting as barriers to dislocation motion during deformation. Indirect strengthening is caused when a dispersoid-containing metal is thermomechanically processed, so that the particles help to develop and stabilize a worked structure. An additional strength increment resulting from the fine grain size and substructure can be achieved at high temperature if the structure is stable. Carbides have been the favored second-phase particle for strengthening molybdenum, as is evident in the commercially available Mo-TZM and Mo-TZC molybdenum alloys. Mo-TZM is an arc cast and powder metallurgy product containing 0.5% by wt. Ti, 0.08% Zr, 0.02% C, and the balance Mo. Mo-TZC is an arc cast and powder metallurgy product containing 1.25% by wt. Ti, 0.15% Zr, 0.15% C, and the balance Mo. However, these alloys do not possess sufficient creep or tensile strength to survive operating temperatures at or above 2400° F. (0.55 $T_m$ of molybdenum) for long-term service applications. These alloys, strengthened by a combination of solid-solution strengthening additions and carbide particles (precipitation strengthening) plus thermomechanical processing, lose their desired mechanical properties in relatively short time periods above these temperatures. The carbide particles are not stable at high temperature and will coarsen and/or dissolve into solution, thereby negating their effectiveness as a strengthener.

The development of a thermally stable, high-strength, molybdenum alloy is highly desirable, and would be useful to extend the lifetime or replace other material systems for a number of important uses. A few of the important uses are for: electrical posts for lamp filaments, creep-resistant boats for nuclear fuel sintering, high temperature components for metal matrix composites for critical high temperature aerospace and space nuclear power and propulsion system components, and medium caliber gun barrel liners for use with high impetus propellants.

An alternative to carbide strengthening of refractory metals such as molybdenum, is strengthening by an oxide dispersion. Tungsten, molybdenum, or their alloys, which are processed using powder-metallurgy techniques, are excellent candidates for oxide dispersion strengthening (ODS) because these metals have very low solubility for oxygen and only moderate affinity to form oxides.

The first oxide dispersion strengthened tungsten alloys containing a coarse, thermodynamically stable oxide (e.g. thoria, $ThO_2$) particle addition, were developed to improve electron emission properties for use as welding rod in the gas tungsten arc (GTA) and other welding processes. However, ODS tungsten alloys containing a finer thoria particle were produced with exceptional creep strength and microstructural stability (i.e. recrystallization temperature, grain growth, etc.) up to 80% of the melting temperature of tungsten (0.8 $T_m$=4839° F.). In fact, the creep strength (i.e., stress to give 1% creep strain in 1,000 hours) of thoriated tungsten alloys was measured to be up to five times higher than commercially-pure tungsten. These alloys are used in several high-temperature applications such as lamp filaments which have improved resistance to shock loading during service, rocket nozzle inserts, and missile nose tips.

Cold-worked pure molybdenum will exhibit poor long-term creep properties above 2000° F. because the cold-worked microstructure is not stable and will recrystallize during service. Some improvements to heat and creep resistance properties of Mo alloys have been made by adding oxides of metals to molybdenum. U.S. Pat. No. 4,950,327 (Eck et al.) discloses a mechanical preparation method, or dry blended process, of preparing an ODS molybdenum alloy, wherein powders of Mo metal and up to 10% by weight of an oxide, or a low temperature decomposable hydroxide or carbonate oxide, are mixed. The resulting powder batch mixture is then cold isostatically pressed (CIP), hydrogen sintered, and processed to wire or sheet. As shown in Table 1 of the Eck et al. patent, the steady-state creep rate of this ODS molybdenum alloy was improved over commercially pure molybdenum. However, no data are given concerning the maximum rupture life and rupture ductility which are more meaningful properties for evaluating the alloy. The ODS molybdenum alloys made by the wet-doping process of the invention disclosed herein, containing 2–4 volume % of the oxides of La, Ce, and Th show improved creep rate and superior rupture life and ductility.

Another method of making a Mo alloy which is creep-resistant up to high temperatures is disclosed in U.S. Pat. No. 4,622,068 (Rowe et al.). The method is a wet-doping process wherein Mo metal or Mo oxide is mixed with the salt of a metal. Under the conditions of the process, a Mo alloy is produced which contains 0.2 to 1% by weight of the metal oxide. Lanthanum salts. are not disclosed, nor are oxide weights above 1% disclosed. No mechanical property test data for the alloy produced are given in the Rowe et al. patent.

Therefore there is a need for a molybdenum alloy which will have sufficient and stable creep strength, over a long period of time, and sufficient tensile strength, to be stable at operating temperatures above 0.55 $T_m$ of Mo, i.e. above 2400° F. (1315° C.).

It is an object of the present invention to provide a thermally stable molybdenum alloy at temperatures above 2400° F.

It is another object of the invention to provide a molybdenum alloy with high tensile strength.

It is a further object of the invention to provide a molybdenum alloy which has improved creep resistance especially above 2400° F.

It is yet another object of the invention to provide a molybdenum alloy with improved ductility.

The present invention provides a wet-doping process wherein salts of the metal lanthanum, cerium, thorium or yttrium are added to molybdenum oxide to produce a fine-grained oxide-dispersion strengthened (ODS) molybdenum alloy containing about 2–4% by volume (~1–4 weight percent) of the oxides of lanthanum, cerium, thorium or yttrium.

BRIEF DESCRIPTION OF THE DRAWINGS

FIG. 1: A table of the chemical analysis results of the alloys of the invention following the thermomechanical processing step.

FIG. 2: A table of the oxide particle and primary grain size of the alloys of the invention after the sintering step, and after the final thermomechanical steps.

FIG. 3: A table of the one hour recrystallization temperatures of the thermomechanically processed alloys of the invention, commercial Mo alloys, and other ODS systems.

FIG. 4: The room temperature tensile data for unalloyed Mo and alloys of the invention.

FIG. 5: The room temperature tensile data for unalloyed Mo and alloys of the invention after they have been vacuum annealed at 3630° F.

FIG. 6: Some ductile-to-brittle transition temperatures of unalloyed Mo and the alloys of the invention.

FIG. 7: Tensile data for unalloyed Mo and thermomechanically processed alloys of the invention at a temperature of 2910° F.

FIG. 8: Tensile data for unalloyed Mo and thermomechanically processed alloys of the invention at a temperature of 3272° F.

FIG. 9: Constant-load, uniaxial creep data for unalloyed. Mo and alloys of the invention.

DETAILED DESCRIPTION OF THE PREFERRED EMBODIMENTS

Figure 10:
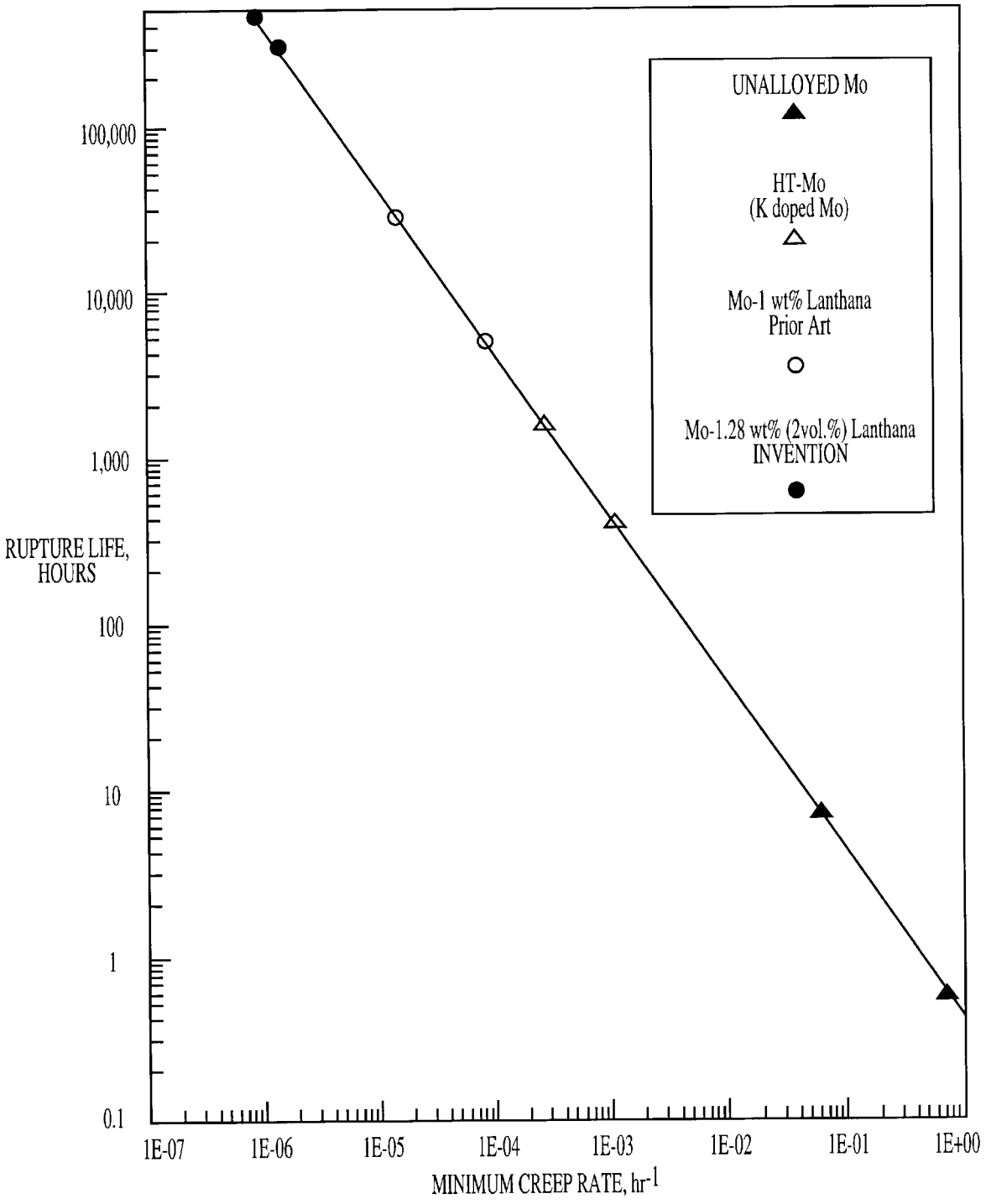
FIG. 10: A plot of the minimum creep rate vs. time-to-rupture, according to the Monkman-Grant relationship, for the invention alloy containing 2% by volume of lanthana, unalloyed Mo and some prior art Mo alloys.

The method of the invention produces a fine-grained molybdenum alloy containing a dispersion of fine (having ~0.5 pm or less diameter), inert metal oxide particles. A fine-grained microstructure improves both ductility and fracture toughness, and a dispersion of fine oxide particles (i.e., a large particle density and.small interparticle spacing) impedes both grain boundary and dislocation mobility. For service conditions above 0.55 $T_m$, creep deformation is dependent on these mobilities and would, therefore, be strongly improved by the presence of a finer oxide particle dispersant. A series of ODS molybdenum alloys containing fine particle additions of lanthana, ceria, thoria and yttria were prepared by the process of the invention detailed below, and the alloys were evaluated for creep-resistance and other physical properties.

The method of the invention comprises the steps of:

(a) forming a slurry of molybdenum oxide and an aqueous solution of a metal salt selected from nitrates or acetates of lanthanum, cerium, thorium or yttria;

(b) heating said slurry in a hydrogen atmosphere to produce a powder of molybdenum and the oxides of said metal salt;

(c) mixing and cold isostatically pressing said powder;

(d) sintering said powder from step (c) in a hydrogen atmosphere to produce a sintered product; and (e) thermomechanically processing said sintered product to a total reduction in cross-sectional area of 93–99%, to produce a molybdenum alloy containing an oxide dispersion of lanthanum, cerium, thorium, or yttrium oxide. The total reduction in cross-sectional area (RA) is determined by $\%RA=A_0-A_F/A_0\times100$, where $A_0$=initial area and $A_F$=final area.

When starting with the acetate or nitrate salt of La, Ce or Y, the thermomechanical processing step comprises hand and machine swaging the sintered product, followed by cold drawing. When employing the thorium salt (or the lanthanum salt), the thermomechanical processing comprises heated extrusion followed by heated hand swaging.

The reduction step of the process, step (b), is carried out in a temperature range of 600°–1000° C. (1112°–1832° F.) for approximately 6–24 hours (lower temperatures requiring longer times). Complete reduction is determined by the color and weight change of the powder. The sintering step (d) is carried out at 1900°–1950° C. (3452°–3542° F.) for about 3–7 hours for La, Ce, and Y, and at a temperature not to exceed about 1300° C. (2372° F.) for about 2 hours for Th (and is applicable for La also). The sintering step is continued until a density of greater than 97% of the theoretical density of Mo is reached. A separate drying step may be added after step (a) at temperatures of about 120°–150° C. (250°–300° F.) for up to 24 hours. Generally, in a production line process the slurry is dried by ambient heat as it is moved slowly in trays toward the entrance to the hydrogen furnace. The pH of the aqueous nitrate (or acetate) salt solution should be adjusted in step (a) to produce the finest anhydrous precipitate following the drying step. The isostatic pressing of step (c) is carried out above about 30,000 psi for times greater than 5 minutes but not to exceed 150 minutes.

The Mo alloy product produced by the process of the invention contains from about 2 to 4 volume percent (~1 to 4% by weight, preferably 1.3–3.9% by weight) of the oxides of La, Ce, Th or Y. The alloy has an average grain size (width) of approximately 0.23–1.0 micrometers, and the average diameter of the oxide particles in the alloy is about 0.05–0.73 micrometers. The total reduction in area following the thermomechanical processing (extruding, swaging, drawing) step is at least 93% and up to greater than 99%

Although yttria is included in the process disclosed above, and is shown in the Figures, in contrast to the greatly improved creep-resistance shown by the other molybdenum-metal oxide alloys it was found that the creep-resistance of the yttria alloy was only slightly better than that exhibited by pure Mo. The process of the invention employing yttria also required some special processing steps.

The preparation of the alloy according to the invention is explained in greater detail in the following non-limiting examples. In addition to the examples disclosed, the starting materials may be mixtures of any two or more of the salts of La, Ce and Th.

EXAMPLE I

The process disclosed below can be used starting with salts of La or Ce. For purposes of illustration this example is for La only.

An aqueous solution was prepared by dissolving 589 g of lanthanum nitrate in 15 liters of water. A slurry was formed by mixing the aqueous solution with 30 kg of molybdenum oxide powder. The slurry was dried at about 255°–300° F. (125°–150° C.) for approximately 8 hours. The dried slurry then was heated at 1200°–1300° F. (650°–690° C.) in a hydrogen atmosphere for 10 hrs., thereby reducing the Mo oxide to Mo metal and converting the nitrates to oxides. The powder produced was ball-milled and cold isostatically pressed at about 35,000 psi for at least 15 min. to produce 1.180 inch diameter billets. The billets were sintered in a hydrogen atmosphere at 3450°–3540° F. (1900°–1950° C.), for 3–7 hrs. The "as-sintered billets" were preheated in a hydrogen atmosphere, hand and machine swaged to 0.285 inch diameter, and cold drawn to a final diameter of 0.156–0.163 inch. The resulting rods were then straightened, sectioned, cleaned in a caustic bath of potassium hydroxide, and trimmed. The final product Mo alloy contained about 2 volume percent of lanthanum oxide ($La_2O_3$).

The process starting with a yttrium salt was essentially the same as above except that the billets (after sintering, as described above) were alternately swaged and resintered independently until the diameter was about one inch, at which stage full densification was achieved, followed by thermomechanical processing to achieve a reduction in area of at least 93% up to greater than 99%.

EXAMPLE II

This example describes the process used to prepare a molybdenum alloy containing an oxide dispersion of about 2% by volume of thoria particles. The same process steps can also be used starting with lanthanum nitrate (or acetate) in place of the thorium salt.

39.5 g of thorium nitrate, $Th(NO_3)_4$, were mixed with ~1000 ml. of water. About 2 kg of molybdenum dioxide powder ($MoO_2$) were added to the aqueous salt solution and stirred until uniform wetting of the $MoO_2$ was achieved and a slurry was formed. The slurry was poured into a stainless steel V-blender, and the slurry was blended for about 4 hours. The blended mixture was poured into one or more PYREX® or stainless steel pans or trays and then dried in a vacuum oven at 250°–300° F. (120°–150° C.) for up to 24 hours. Periodically the oven was pressurized to atmospheric pressure with Ar gas, and the powder mixture was examined to determine the status of the drying process (i.e., no further significant weight loss). The dried powder mixture was poured into one or more molybdenum trays or pans to a maximum depth of one half of an inch. The powder mixture was reduced in a flowing dry hydrogen atmosphere at a temperature not exceeding 1300° F., for up to 24 hours. Periodically the powder mixture was removed and examined during this 24 hour period to ensure complete reduction, i.e., weight loss of approximately 25% and a brown/burgundy to grey color change. Next the trays were moved to the cooling zone of the furnace, the system was purged with high-purity (>99.99%) nitrogen gas, and then the trays were allowed to cool below 90° F. The cooled trays containing the completely reduced powder mixture were removed from the hydrogen furnace. The powder mixture was placed back into the V-blender, the ports were sealed, and then the blender was turned on. The mixture was blended for an additional four hours.

A two kilogram batch of blended powder was cold isostatically pressed (CIP) at 40,000 psi for at least fifteen minutes, producing a cylindrical billet approximately 1.5 inch diameter by 4 inches long. The pressed billet was then heated in hydrogen ("sinter" or pre-consolidation anneal) for 2 hours at a temperature not exceeding 2400° F. The cleaned billet was inserted into a molybdenum extrusion canister, tack welded, leak checked, and then seal welded. The extrusion canister was heated to 2500° F. under a hydrogen atmosphere and held for 30 minutes. The heated canister was then extruded to a round bar at a 4:1 reduction ratio using a high-rate extrusion press (DYNAPAK®). The clad extrusion billet (0.91 inch diameter) was hand swaged to 0.245 inch diameter in twenty-seven passes. The initial swaging temperature ranged from 2300° to 2350° F. and was reduced in stages to the final preheat temperature ranging from 1450° to 1475° F. The molybdenum clad was removed from the as-swaged rod by centerless grinding to yield a final alloy rod of nominally 0.160 inch diameter. The product alloy contained about 2 volume percent thoria ($ThO_2$) particles.

Experimental Results

Material Characterization:

Physical Properties: The average measured densities of the as-sintered alloys ranged between 96.7 and 98.9% of the theoretical density (TD) calculated for each alloy composition. The average measured densities of the alloys after the thermomechanical processing (extrusion, swaging, drawing) ranged between 99.9 and 100% TD. The theoretical density of these alloys is assumed to be a weighted average of the oxide dispersant and molybdenum theoretical densities according to the law of mixtures. No significant porosity was observed during optical metallographic examination, except for the pull-out of oxide particles from the molybdenum matrix. However, during the transmission electron microscopy (TEM) examination of as-swaged ODS alloy compositions, microvoids were detected between oxide dispersants and the molybdenum matrix.

Chemical Analysis: The results of chemical analysis are presented in FIG. 1. With the exception of the 4% vol. lanthana compositions, all lots were reasonably close to the targeted two and four volume percent dispersant levels. The lower than desired volume fractions obtained on the 4% by volume alloy containing lanthana probably resulted from the slightly lower melting temperature (e.g., $La_2O_3$=4100° F.; $CeO_2$=4530° F.; $Y_2O_3$=4405° F.) causing evaporation during sintering.

Microstructural Characterization: The microstructure of the as-swaged ODS alloys are characterized by refined and elongated grains with an average grain width of about 0.23 to 1.0 micrometers. The average aspect ratios (average grain length/average grain width) were extremely difficult to measure optically because the length and width of these elongated grains were difficult to distinguish. The average aspect ratio was impossible to measure in the transmission electron microscopy (TEM) because the length of grains extended beyond the diameter of the TEM foil. However, the aspect ratios of vacuum annealed elongated grains were between 10/1–100/1. The average grain size of as-sintered and fully swaged/drawn ODS molybdenum alloys are compared in the table shown in FIG. 2. The size and shape of the oxide dispersants can be classified into two groups: non-deformable, spherical particles (e.g., yttria ODS alloys) and deformable particles (e.g., lanthana, ceria and thoria ODS alloys). During swaging, the oxide particle size is sequentially reduced to the fully swaged condition. The shape of the oxide particles within the as-sintered alloys were blocky (i.e. polygon shape) or generally spherical. However, following the swaging and drawing processes, the softer lanthana and ceria particles plastically deformed into stringers which even segmented into smaller more spherical particles. The size and shape of the harder yttria particles, on the other hand, remained unchanged. The process of the invention produced ODS alloys, especially for the ceria and lanthana dispersants, with a very fine oxide particle size of about 0.05 to 0.5 micrometers, and a larger density of particles. As a result of this the ODS alloy of the invention has an increased creep strength and increased thermal stability (i.e., increased recrystallization temperature).

Processing the alloy with yttria, by the process of the invention, resulted in a marginal increase in recrystallization temperature and only a slight improvement in creep resistance compared with pure molybdenum, even though the alloy exhibited a fine oxide particle and grain size.

Microstructural Stability Properties:

The only important strengthening mechanism in pure metals at ambient and elevated temperature is work- or strain-hardening and the subsequent retention of a strain-hardened (elongated) microstructure at elevated temperature. During strain-hardening, the yield and tensile strengths and electrical resistivity are increased due to the generation of dislocations and the refinement (elongation) of the microstructure, whereas the ductility and, in some cases, the resistance to corrosive attack are dramatically reduced. Following subsequent thermal exposures (annealing), the material slowly reverts back to its pre-hardened condition. These processes are referred to as recovery, recrystallization, and grain growth. Recovery is the process whereby a small amount of the stored energy of cold work is released resulting from the rearrangement of mobile dislocations into distinct cells and the annihilation of excess vacancies. During recovery, no significant change in microstructure or mechanical properties occurs; however, there is a marked decrease in the electrical resistivity of the material. Recrystallization is the process which follows recovery whereby the remaining stored energy of cold work is released resulting in a dramatic change in the microstructure and mechanical properties of the cold-worked material. Recrystallization is characterized by the nucleation and growth of new, strain-free grains, a decrease in the yield and tensile strengths due to the annihilation of dislocations and grain growth, and an increase in the ductility and corrosion resistance of the material. The recrystallization temperature is defined as the temperature at which a material in a highly cold-worked state fully recrystallizes (i.e., nucleates and grows a new, strain-free equiaxed grain) in one hour. Experimentally, the recrystallization temperature is determined by both a decrease or drop in the as-worked hardness and the presence of new, strain-free equiaxed grains. The last process is grain growth. Grain growth is the preferential increase in the average grain diameter of the material. The thermodynamic driving force for grain growth is the reduction in grain boundary area and the subsequent decrease in the surface energy of the boundary. Grain growth is also characterized by a softening or decrease in the yield and ultimate tensile strengths of the material.

The recrystallization temperature (RXT) and stability of the as-swaged microstructure were determined following one hour vacuum ($<10^{-5}$ torr) anneals at temperatures between 2910° and 3990° F. (1600°–2200° C.) at intervals of 180° F. The RXT measured from both microstructure and hardness changes of each of the alloys are listed in FIG. 3. Five alloy compositions—2 and 4 volume percent ceria, 2 and 4 volume percent lanthana, and 2 volume percent thoria—were identified which have RXT greater than both unalloyed and alloyed molybdenum (TZM and TZC commercial Mo alloys). Three alloy compositions—2 volume percent thoria, 4 volume percent ceria, and 4 volume percent lanthana—were identified which have RXT greater than a carbide-dispersion strengthened molybdenum-2.0 wt. % rhenium alloy. However, the RXTs of the yttria alloys were only slightly greater than unalloyed molybdenum. The RXT of commercial unalloyed molybdenum is between 1600° and 2300° F. depending on the purity of interstitiais, strain and strain hardening rates, time at temperature during forming, and applied stress; whereas the RXT of commercial molybdenum alloys is between 2450° and 2800° F. In fact, three alloy compositions were identified with RXT of 70–84% of the melting temperature. As for other ODS systems, RXT in excess of 80% of the melting temperature of the unalloyed metal are typical. For instance, the RXT for TDNi (ODS thoria-nickel alloy) and ThDW (ODS thoria-tungsten alloy) are 2465° F. (1350° C.) and 5250° F. (2900° C.), respectively.

Mechanical Properties:

Ductile-to-Brittle Transition Temperature (DBTT): The DBTT was determined for each product invention alloy after the final thermomechanical processing step (as-swaged), and also for each alloy produced by the process of the invention, subjected to a high temperature vacuum anneal. The DBTT was determined by uniaxially loading a tensile specimen to failure at an ambient temperature range between 212° F. and −148° F. and by measuring the 0.2% offset yield stress, ultimate tensile stress, the percent uniform elongation, the percent elongation to failure, and the reduction in area (measured from electron micrographs, i.e., SEM images). The room temperature tensile data of the as-swaged ODS alloy compositions and as-swaged alloy compositions which were then vacuum annealed at 3630° F. for one hour are presented in FIGS. 4 and 5, respectively. At room temperature, the elongations to failure of the as-swaged alloys ranged between 6 and 25%, whereas for the vacuum annealed alloys the range was 8 to 39%, falling sharply as the DBTT is approached.

The DBTT of as-swaged and vacuum annealed ODS molybdenum alloys are listed in FIG. 6. The as-swaged ODS molybdenum alloys remained ductile to temperatures well below room temperature (<58° F.). However, two of the vacuum annealed ODS molybdenum alloys (i.e., 4 vol. % ceria and lanthana) remained ductile to temperatures below room temperature, whereas the remaining two alloys. (i.e., 2 vol. % ceria and lanthana and 2 and 4 vol. % yttria) were not ductile at room temperature. Except for the ODS alloys containing 4 volume percent ceria and lanthana particles the microstructures of the vacuum annealed alloys were fully recrystallized. This coarse grain size allows for a greater concentration of dislocation pileups at grain boundaries as well as lowering the number of dislocation sources available to accommodate slip, i.e., plastic deformation. These alloys were substantially more ductile and formable than any tungsten-base system.

Elevated Temperature Tensile (ETT) Tests: The ETT properties of each as-swaged alloy were determined by uniaxially loading a test specimen to failure at 2910° and 3270° F. The uniaxial tensile properties are shown in FIGS. 7 and 8. The elevated temperature tensile specimens failed intergranularly. Decohesion of grains was observed throughout the region of plastic instability, i.e., the "necked" region. Generally, retaining a fine grain size/microstructure improved the elevated temperature tensile properties.

Constant-Load, Uniaxial Creep Tests: The constant-load, uniaxial creep properties of the ODS molybdenum alloys of the invention were measured between 2730° and 3270° F. (1500° and 1800° C.) with an applied stress between 1.5 and 5.0 ksi (10.3 and 34.4 $N/mm^2$) in dynamic vacuum ($<10^{-7}$ torr), and are listed in FIG. 9. The creep properties of a Mo alloy made by the process of the invention were.compared to those of unalloyed Mo and prior art Mo alloys made by a dry-blending process. FIG. 10 is a plot of the minimum creep rate vs. time-to-rupture for unalloyed Mo, a prior art HT-Mo alloy (potassium-doped Mo), a prior art Mo alloy containing 1% by weight of $La_2O_3$ prepared by a dry-doping process, and the alloy of the invention containing 2% by volume (1.285% by weight) of lanthanum oxide. The plot in FIG. 10 is based on the Monkman-Grant relationship (F. C. Monkman and N. J. Grant, "An Empirical Relationship Between Rupture Life and Minimum Creep Rate in Creep Rupture Tests", *Proc. ASTM*, 56, 593, 1956). Monkman and Grant have shown that when the log of the time-to-rupture is plotted against the log of the linear creep rate, a linear relationship is obtained with a slope of m, in accordance with:

$$\log t_R = \log C + m \log \epsilon_{ss}$$

where $t_R$=rupture time $\epsilon_{ss}$=steady state creep rate and m and C are constants.

For most metal alloys including molybdenum, the constant "m" is equal to minus one (−1), and the equation becomes:

$$t_R = C/\epsilon_{ss}$$

The Monkman-Grant relationship is considered appropriate for comparison purposes since it is applicable for powder metallurgy molybdenum, and the alloys of the invention and the prior art alloys shown in FIG. 10 were prepared by powder metallurgy procedures.

As can be seen from FIG. 10, the alloy produced by the wet-doping process of the invention shows a significant improvement in creep properties over unalloyed Mo and over the prior art alloys produced by a dry-blending process. The minimum creep rate of the alloys made by the process of the invention is much smaller, and the time to rupture is much longer than the prior art Mo alloys.

While the present invention has been described with respect to exemplary embodiments, it will be understood by those of ordinary skill in the art that variations and modifications can be effected within the scope and spirit of the invention.

We claim:

1. A process for producing a high-strength, creep-resistant molybdenum alloy, containing fine oxide particles, comprising the steps of:

(a) forming a slurry of molybdenum oxide and an aqueous solution of a metal salt selected from nitrates or acetates of lanthanum, cerium, or thorium;

(b) heating said slurry in a hydrogen atmosphere to produce a powder of molybdenum, and the oxides of said metal salt;

(c) mixing and cold isostatically pressing said powder;

(d) sintering said powder from step (c) in a hydrogen atmosphere to produce a sintered product; and (e) thermomechanically processing said sintered product to a total reduction in cross-sectional area of 93–99%, to produce a molybdenum alloy containing an oxide dispersion of lanthanum, cerium, or thorium oxide.

2. The process of claim 1 wherein said molybdenum alloy contains from about 2 to 4% by volume of an oxide of lanthanum, cerium, or thorium.

3. The process of claim 1 wherein said metal salt is selected from acetates or nitrates of lanthanum or thorium.

4. The process of claim 3 wherein said thermomechanical processing comprises heated extrusion followed by heated hand swaging of said sintered product.

5. The process of claim 1 wherein said metal salt is selected from acetates or nitrates of lanthanum or cerium.

6. The process of claim 5 wherein said thermomechanical processing comprises hand and machine swaging said sintered product followed by cold drawing.

7. The process of claim 1 wherein said heating in hydrogen in step (b) is carried out at about 600°–1000° C. for about 6–24 hours.

8. The process of claim 5 wherein said sintering in step (d) is carried out at about 1900°–1950° C. for about 3–7 hours.

9. The process of claim 3 wherein said sintering in step (d) is carried out at a temperature not to exceed about 1316° C. for about 2 hours.

10. The process of claim 1 further comprising drying said slurry from step (a) at about 120°–150° C., for up to 24 hours, prior to said step of heating in the hydrogen atmosphere.

11. The process of claim 6 further comprising a step of preheating said sintered product from step (d) in a hydrogen atmosphere before said step of hand and machine swaging.

12. The process of claim 2 wherein said oxide is $La_2O_3$, $CeO_2$, or $ThO_2$ and said volume percent is about 2%.

13. A creep-resistant, oxide-dispersion strengthened, molybdenum alloy made by the process of:

(a) forming a slurry of molybdenum oxide and an aqueous solution of a metal salt selected from nitrates or acetates of lanthanum, cerium, or thorium;

(b) heating said slurry in a hydrogen atmosphere to produce a powder of molybdenum and the oxides of said metal salt;

(c) mixing and cold isostatically pressing said powder;

(d) sintering said powder from step (c) in a hydrogen atmosphere to produce a sintered product; and (e) thermomechanically processing said sintered product to a total reduction in cross-sectional area of 93–99%.

14. The alloy of claim 13 containing from about 2 to 4% by volume of an oxide of lanthanum, cerium, or thorium.

15. The alloy of claim 14 wherein said volume percent is 2%.

16. The alloy of claim 14 having an average grain size of about 0.2 to 1 micrometers.

17. The alloy of claim 14 containing a fine dispersion of said oxide particles having an average oxide particle diameter of about 0.05 to 0.73 micrometers.

18. The alloy of claim 14 having a recrystallization temperature of up to 2200° C. (3990° F.).

19. The alloy of claim 14 having a minimum creep rate of less about $10^{-3}$% per hour with a total creep elongation of less than 1.5% under an applied constant stress of 1.5 to 5 ksi at temperatures of 1500° to 1800° C.

20. The alloy of claim 14 having an ultimate tensile strength at room temperature in the range of about 119,000 to 159,000 psi, and an ultimate tensile strength at 2910° F. in the range of about 7,000 to 16,300 psi.

21. The alloy of claim 14 wherein said heating in hydrogen in step (b) is carried out at about 600°–1000° C. for about 6–24 hours.

22. The alloy of claim 14 wherein said oxide is lanthanum oxide or cerium oxide, and said Sintering in step (d) is carried out at about 1900°–1950° C. for about 3–7 hours.

23. The alloy of claim 22 wherein said thermomechanical processing comprises hand and machine swaging said sintered product followed by cold drawing.

24. The alloy of claim 14 wherein said oxide is lanthanum oxide or thorium oxide, and said sintering in step (d) is carried out at a temperature not to exceed about 1316° C. for about 2 hours.

25. The alloy of claim 24 wherein said thermomechanical processing comprises heated extrusion followed by heated hand swaging of said sintered product.

26. The alloy of claim 14 wherein said slurry from step (a) is dried at about 120°–150° C., for up to 24 hours, prior to said step of heating in the hydrogen atmosphere.

27. The alloy of claim 23 wherein said sintered product from step (d) is preheated in a hydrogen atmosphere before said step of hand and machine swaging.

28. The alloy of claim 14 wherein said oxide is $La_2O_3$, and said volume percent is about 4%.

29. The alloy of claim 14 having a room temperature elongation to failure of about 6 to 24%, and reduction in area following tensile stress testing in the range of about 30 to 60%.

30. The alloy of claim 14 having a room temperature ultimate tensile stress in the range of about 76,000 to 123,000 psi after vacuum annealing at about 3630° F.

31. The alloy of claim 14 having a room temperature elongation-to-failure in the range of about 25 to 40% and a reduction in area in the range of about 52 to 65% after vacuum annealing at about 3630° F.

32. A molybdenum alloy containing from 2–4% by volume of an oxide dispersion of yttria, made by the process of:

(a) forming a slurry of molybdenum oxide and an aqueous solution of yttrium nitrate;

(b) drying said slurry at about 255°–300° F.;

(c) heating said slurry in a hydrogen atmosphere at about 1200°–1300° F. to produce a powder of molybdenum and yttrium oxide;

(d) mixing and cold isostatically pressing said powder;

(e) sintering said powder from step (d) in a hydrogen atmosphere at about 3450°–3540° F. to produce a sintered billet;

(f) thermomechanically processing said sintered billet by hand and machine swaging:

(g) repeating steps (e) and (f) twice, wherein a fully densified billet is produced; and (h) thermomechanically processing said billet produced after step (g) until a total reduction in cross-sectional area of said billet of 93–99% is achieved.

* * * * *